US006250947B1

(12) United States Patent
Holzer

(10) Patent No.: US 6,250,947 B1
(45) Date of Patent: Jun. 26, 2001

(54) CONTACT-SAFE BASE-AND-SOCKET SYSTEM FOR LIGHTING FIXTURES

(76) Inventor: Walter Holzer, Drosteweg 19, D-88709 Meersburg (DE)

( * ) Notice: Subject to any disclaimer, the term of this patent is extended or adjusted under 35 U.S.C. 154(b) by 0 days.

(21) Appl. No.: 09/338,683

(22) Filed: Jun. 23, 1999

(30) Foreign Application Priority Data

Jul. 20, 1998 (DE) ..... 198 32 352

(51) Int. Cl.[7] ..... H01R 13/64
(52) U.S. Cl. ..... 439/379; 439/356
(58) Field of Search ..... 439/660, 680, 439/611, 617, 618, 356, 699.2, 378, 379

(56) References Cited

U.S. PATENT DOCUMENTS

| | | | | |
|---|---|---|---|---|
| 2,343,675 | * | 3/1944 | Kenyon | 439/379 |
| 4,667,270 | * | 5/1987 | Yagi | 361/380 |
| 5,800,183 | * | 9/1998 | Paul et al. | 439/56 |
| 6,033,249 | * | 3/2000 | Holzer | 439/356 |

* cited by examiner

*Primary Examiner*—Tulsidas Patel
(74) *Attorney, Agent, or Firm*—Marshall, O'Toole, Gerstein, Murray & Borun

(57) ABSTRACT

The invention relates to an arrangement for the easier inserting of pin bases into sockets, by means of closed-form guide profiles which are used simultaneously for coding, in order to prevent the installing of lamps into sockets unsuited therefor.

7 Claims, 2 Drawing Sheets

CONTACT-SAFE BASE-AND-SOCKET SYSTEM FOR LIGHTING FIXTURES

BACKGROUND OF THE INVENTION

Electric lamps or light bulbs are typically equipped with either threaded Edison sockets or bayonet sockets, both of which present a risk of electrical shock. Contact-hazardous Edison screw sockets and bayonet sockets are accepted worldwide only because hitherto there was not available on the market any completely contact-safe base-and-socket systems which met all international requirements. However, the advent of German patent application 197 06 905.3, (whose U.S. counterpart is U.S. Pat. No. 6,033,249) which describes a faultless construction, has engendered renewed interest in averting this ever present danger.

Any new socket system should be simple, convenient and user-friendly. While lamps equipped with pin-type connectors have been proposed, such lamps present a problem of aligning the pins to the correct plug-in position in a pin socket.

Also the erroneous use of unsuitable lamps for a certain lighting fixture should be avoided. For this, coding measurements should be developed to prevent the use of an incorrect lamp (e.g., a bulb having an improper rating).

The problem of the invention is to fulfill both wishes by a single constructive recommendation.

SUMMARY OF THE INVENTION

As a solution to the above problems it is proposed to provided guide profiles on both the base of the lamp and on the corresponding lamp socket which fit in closed form with one another only in certain positions. Only when the lamp is aligned in the correct position can the lamp with its base be inserted into the socket. This position or positions are given by the correct connecting of the pins of the base with the corresponding contacts of the socket.

It is appropriate to arrange the guide profiles in the center of the base. Locating the guide in this position makes it possible, too, to provide at the ends of the guide profiles a centering projection that permits a rotary movement of the base while installing the lamp. The centering projection facilitates alignment of the apparatus so that the pins of the lamp base agree with the appropriate counter-contacts of the lamp socket.

The closed-form construction of the guide profiles simultaneously renders possible a coding of the socket in order to avoid the careless installing of unsuitable lamps.

BRIEF DESCRIPTION OF THE DRAWINGS

In the following representations there are described schematic examples of execution, and, namely.

DESCRIPTION OF THE PREFERRED EMBODIMENT

The following thorough description of a base according to the invention with a socket appropriate to it serves only for the better understanding of the invention and is by no means to be taken as limitative, since the construction of base and socket is possible in many variations which correspond to the thought of the invention.

Figure 2:
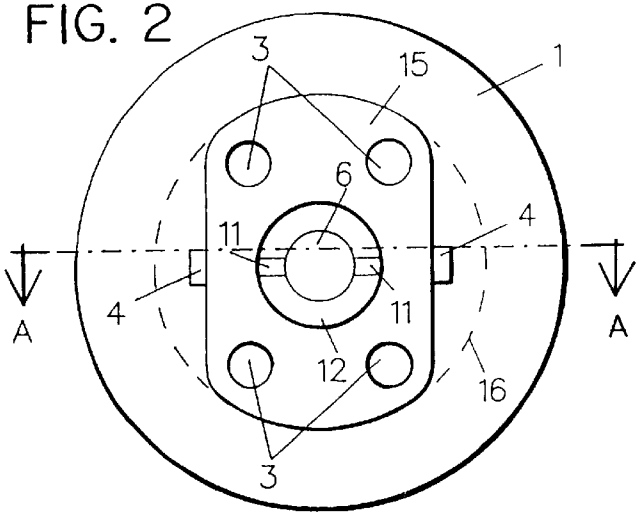
FIG. 2 shows the base of FIG. 1 as seen from the pin side.
Figure 1:
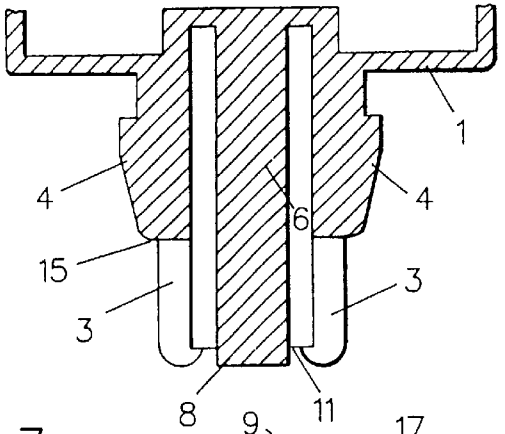
FIG. 1 is a sectional view of a lamp base according to the invention.
Figure 3:
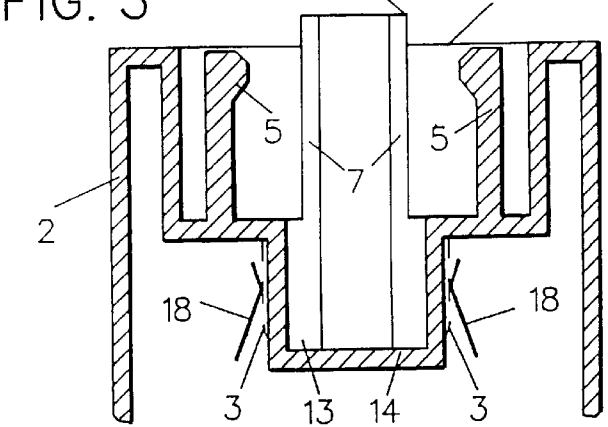
FIG. 3 is a sectional view through the socket adapted to receive the lamp base of FIG. 1.

FIG. 1 shows schematically a section, taken along section A—A of FIG. 2, of a base (1) of a lamp or light bulb (not shown). Base (1) fits into a contact-safe socket, likewise represented only schematically in section in FIG. 3. FIG. 3 is also a sectional view, taken along section B—B of FIG. 4. The example corresponds essentially to a preferred embodiment of German patent application Ser. No. 197 06 905.3 (U.S. Pat. No. 6,033,249).

Base (1) can be provided with maximally four pins (3) which are arranged on a face surface (15) of base (1), and extends vertically therefrom. Pins (3), as well as rigid rests (4) that are present on both sides of the base (1)—as is to be seen in FIG. 2—lie within a circle (16) with a minimal diameter. This miniaturization is of the greatest importance in order to make it possible to install the new base system by means of adapters into the sockets of hitherto conventional lamp bases or sockets. This emplacing given by standard publications substantially rendered difficult the solution of the concept of the invention and thereby increases the level of invention, since it gives a usable solution even with the closest spatial relations.

Figure 4:
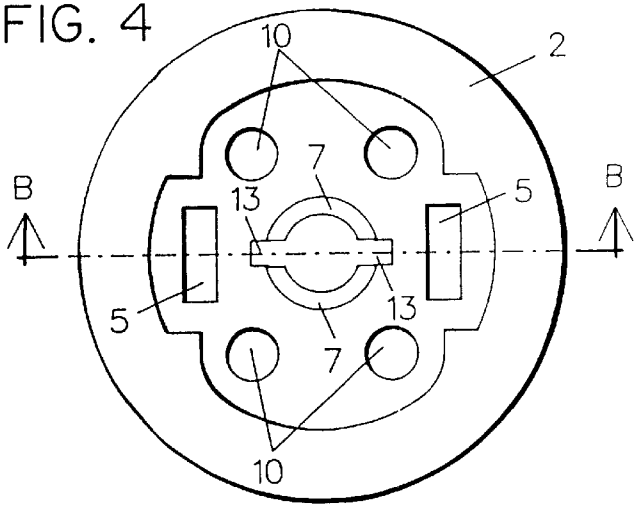
FIG. 4 is a top view of the socket before insertion of the base.

FIG. 3 depicts elastic rests (5) of the socket (2) which correspond with the rigid rests (4) of the lamp base. Elastic rests (5) are constructed in this example as elastic plastic fingers, but could, however, also be made of metal, since they do not come in contact with any electrical parts. FIG. 4 shows that the arrangement of the holes (10) which correspond with the pins (3) of the base (1), and the elastic rests (5) lie within a small circle.

In the center of the base (1) there is provided in this example a cylindrical lamp base guide profile (6) which can be inserted into the socket guide profile (7) of the socket (2). Insertion of lamp base guide profile (6) into socket guide profile (7) can be accomplished only if the lateral projections (11) of the lamp base guide profile (6) are present in front of slots (13) of the socket guide profile (7). As long as this is not the case, a lamp with a base (1) cannot be installed in the socket (2). It is necessary, therefore, to rotate the lamp until the guide profiles are congruent and only then is it possible to insert the lamp.

The search for the correct insertion position is facilitated according to the invention through the feature that at the end of the guide profile (6) a centering projection (8) extends somewhat beyond the lateral projections or lugs (11) and in the inserting into the annular socket guide profile (7) the necessary rotary movement is centered until closed-form engagement of the lugs (11) with the slots (13) is reached.

Since the search for the correct insertion position must begin before the pins (3) touch the front side (17) of the socket (2), the lugs (11) must have reached the end (9) of the guide profile (7)—which in this example is represented in the form of two cylinder halves. In designing a base/socket system, it is necessary to carefully consider the stroke of the insertion movement in order not to impair other components in the base (1) or in the socket (2). Parts extending into the base (1) could hamper, for example, the accommodation of so-called "pump stalks" required for pumping air out of the lamps in the manufacturing process. In the socket, on the other hand, the requisite space for the electrically conductive, elastic counter-contacts (18) should be kept free, as schematically shown in FIG. 3.

FIG. 3 also depicts the electrical contact between pins (3) (shown in dotted lines) with electrically conductive contacts

(18) at the bottom of socket holes (10). Electrical contacts (18) are connected, via internal and external wiring, to a source of mains power.

According to the invention a well-considered dimensioning of the guide profiles is accomplished by providing that guide (6) is slightly longer than the length of pins (3), and the guide profile (7) in socket (2) extends somewhat beyond the front face (17) of the socket (2), in order not to let the bottom (14) extend too far into the interior of the socket (2).

This recommendation is not compulsory. In certain uses it could be advantageous to accommodate the entire stroke length in the base (1) or in the socket (2).

For the better understanding of the coding, FIGS. 5 through 10 show three different examples and their possibilities of utilization.

Figure 5:
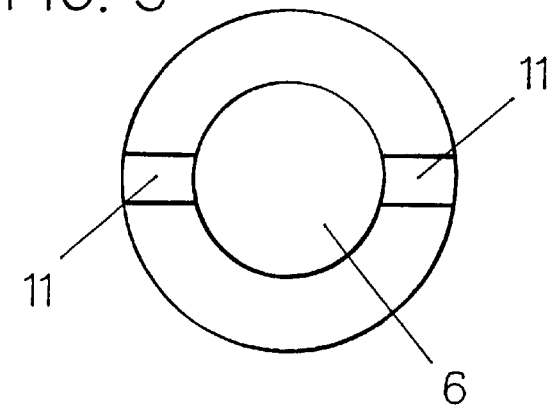
FIGS. 5–10 represent coding examples of guide profiles for socket and base structures which can be used in the present invention.
Figure 6:
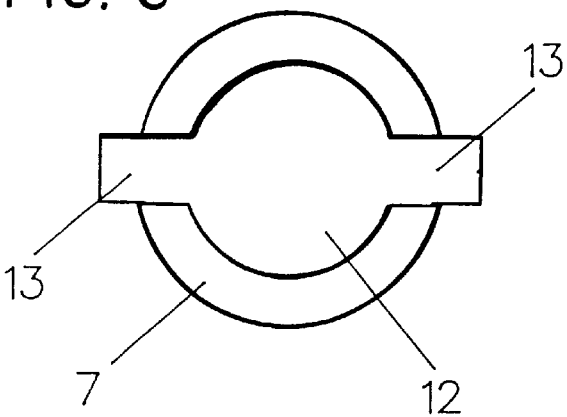

FIG. 5 and FIG. 6 show the execution as represented in FIG. 1 to FIG. 4. There on the guide profile (6) of the base (1), which is executed as a cylindrical pivot, there are present two projections, which in the action of plugging-together with the socket (2) slide into the slots (13) of the tubes (12). Installing the base (1) into the socket (2) offset by 180 angular degrees is possible and in many cases desired in order to shorten the search for the correct position for the insertion. This holds in practice for all instances involving incandescent bulbs, which require only 2 electrical connections that can be arranged symmetrically.

Figure 9:
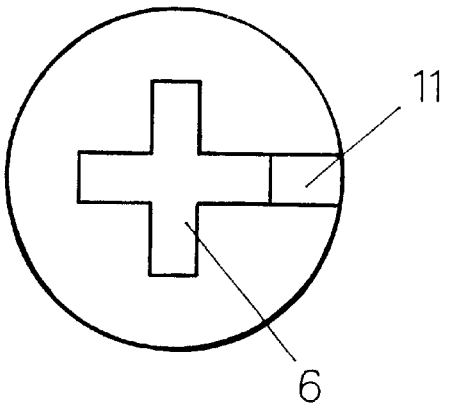

A lamp with a base according to FIG. 9 could likewise be directly installed into the socket according to FIG. 6. What does this mean as coding? It would be possible, for example, to equip 115 volt lamps with a base according to FIG. 5, which would have to be installed into a socket according to FIG. 6. However, the lamp having a base in accordance with FIG. 5 will not fit in sockets according to FIG. 10, which, for example, could be provided for 230 volt lamps. The use of this sample coding prevents damaging of the 115 volt lamps operating at excessive voltage.

Figure 10:
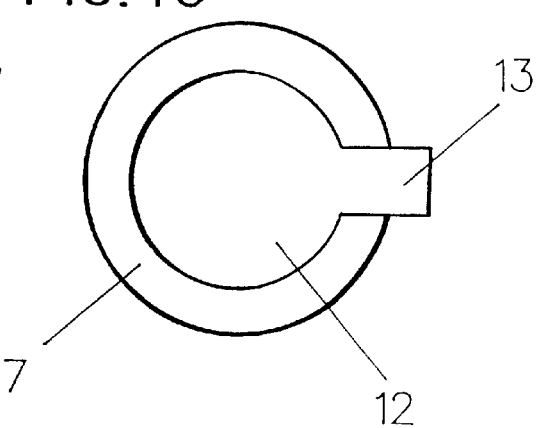

The converse case, inserting a 230 volt lamp with base according to FIG. 10 into a socket according to FIG. 6 is, to be sure, possible, but unobjectionable, since the lamp is not damaged by the lower voltage.

Figure 7:
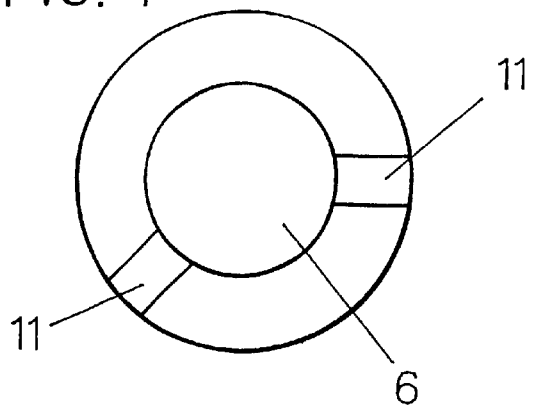
Figure 8:
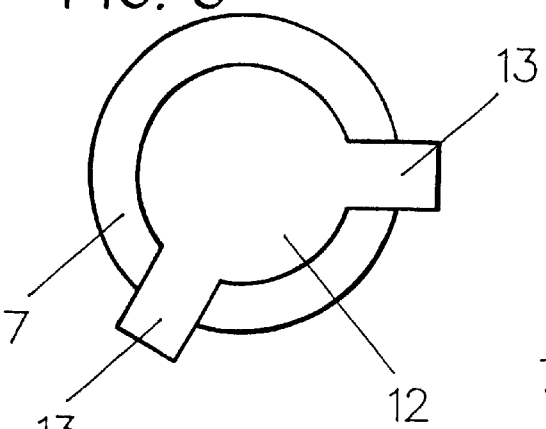

The execution of a coding given in FIG. 7 could be reserved, for example, for energy-saving lamps which must be provided with four connections, for the sockets can be secured against wrong use according to the invention. In this example the projections (11) must be brought in congruent position with the slots (13) of FIG. 8, in order to make it possible to install a lamp with the base according to FIG. 7. Damage to incandescent lamps with a four-pin base having the configuration of FIG. 8, which are inadvertently plugged into the wrong pin positions in a FIG. 8 socket, can be avoided simply by the means that the pin position in the socket (2) according to FIG. 8 is correspondingly provided, since in the case of energy-saving lamps not all the contacts conduct hazardous voltages.

FIG. 9 shows also that the guide profile (6) of the base (1) does not absolutely have to be executed as a cylinder. Also a cross-shaped guide profile (6), which is to be preferred for reasons of plastic technology, fulfills all the functions of the present invention.

Briefly, what is disclosed is a base-and-socket system for olghting fixtures which is adapted both to minimize the risk of electrical shock during the bulb changing process and to ensure that a bulb is plugged into only an appropriate socket. The system employs a two-to-four-pole pin base, the pins of which are arranged on the face surface of the base. The outer form of the base has a circular cross section as basic form and on the base there are present rigid rest profiles that lie inside the circular cross section. The socket used to receive the base has springy counter-contacts and spring catches allocated correspondingly to the base pins, characterized in that on the base and on the socket there are present guide profiles which are congruent only in predetermined positions and thereby permit a plugging of the base into the socket only in the case of agreeing position of the pins with the counter-contacts.

The examples cited cannot cover all the complex possibilities of the invention, but from the representations there proceed many further incentives. Also the coding possibilities given already in DPA 197 06 905.3 (U.S. Pat. No. 6,033,249) are arbitrarily combinable with this invention.

Likewise according to the invention the guide profiles between base and socket are arbitrarily exchangeable with retention of all the functions described. Also the arrangement of the guide profiles on the circumference instead of in the center must be regarded as an equivalent solution under patent law.

What is claimed is:

1. A base-and-socket system for electrical lighting fixtures comprising:

a lamp base having a lamp guide profile extending downwardly from said base, the distal end of said lamp guide profile forming a centering projection for facilitating insertion of said lamp base into a lamp socket;

a plurality of spaced-apart electrical-contact pins extending downwardly from said lamp base;

a plurality of lateral projections extending longitudinally along the outer surface of said lamp guide profile, said lateral projections terminating above said centering projection;

a lamp socket leaving a recessed socket guide profile which is adapted to receive said lamp guide profile, and a plurality of downwardly-depending slots on said socket guide profile which are adapted to mate with the lateral projections on said lamp guide profile;

a plurality of power-supplying counter-contacts in said lamp socket, each of said counter-contacts adapted to engage an electrical contact pin on said lamp base when the base is mounted in the lamp socket;

whereby the lamp base can be inserted into the lamp socket only if said lamp base lateral projections are in register with the slots on said lamp socket.

2. A base-and-socket system according to claim 1, wherein said lamp guide profile and said recessed socket guide profile are arranged, respectively, centrally on the lamp base and centrally in the lamp socket.

3. A base-and-socket system according to claim 1, wherein the centering projection of said lamp guide profile is adapted to ensure a rotating turning movement of the lamp base with respect to the lamp socket.

4. A base-and-socket system according to claim 1, wherein said lamp guide profile has a pair of lateral projections on the profile outer surface, and the lamp socket has a pair of slots corresponding to said lateral projections.

5. The base-and-socket system of claim 4, wherein said pair of lateral projections are offset from one another at an angle of 180 degrees.

6. A base-and-socket system according to claim 1 comprising two electrical contact pins in said lamp base, and two power-supplying counter-contacts in said lamp socket.

7. A base-and-socket system according to claim 1 comprising four electrical contact pins in said lamp base, and four power-supplying counter-contacts in said lamp socket.

* * * * *